US006523486B1

(12) United States Patent
Plitt et al.

(10) Patent No.: US 6,523,486 B1
(45) Date of Patent: Feb. 25, 2003

(54) REMOVABLE EDGE SYSTEM FOR A WORK SURFACE

(75) Inventors: Eugene T. Plitt, Muskego, WI (US); Steve Patrick Kinnard, Milwaukee, WI (US)

(73) Assignee: Bay View Industries, Inc., Oak Creek, WI (US)

( * ) Notice: Subject to any disclaimer, the term of this patent is extended or adjusted under 35 U.S.C. 154(b) by 0 days.

(21) Appl. No.: 09/887,305

(22) Filed: Jun. 22, 2001

(51) Int. Cl.[7] ..... A47B 17/00

(52) U.S. Cl. ..... 108/27; 312/140.4; 52/800.1

(58) Field of Search ..... 108/27, 151, 154; 312/137, 140.1, 140.2, 140.3, 140.4; 52/800.1, 800.11, 782.2; 248/345.1

(56) References Cited

U.S. PATENT DOCUMENTS

| | | | | |
|---|---|---|---|---|
| 4,558,553 A | | 12/1985 | Kolk | |
| 5,208,084 A | | 5/1993 | Rutz | |
| 5,253,932 A | | 10/1993 | Nesovic | |
| 5,471,936 A | * | 12/1995 | Kemnitz | 108/27 |
| 5,546,873 A | | 8/1996 | Conner et al. | |
| 5,551,352 A | * | 9/1996 | Meier et al. | 108/27 |
| 5,628,257 A | | 5/1997 | Conner et al. | |
| 5,830,552 A | * | 11/1998 | Meier et al. | 108/27 |
| 6,025,047 A | | 2/2000 | Catta et al. | |
| 6,135,581 A | * | 10/2000 | Kopp et al. | 108/27 |
| 6,138,435 A | * | 10/2000 | Kocher et al. | 52/800.1 |
| 6,378,831 B1 | * | 4/2002 | Copeland, Jr. | 108/27 |

FOREIGN PATENT DOCUMENTS

| | | | | |
|---|---|---|---|---|
| GB | 2246701 | * | 2/1992 | 108/27 |
| JP | 03143612 | * | 6/1991 | 108/27 |

* cited by examiner

*Primary Examiner*—Lanna Mai
*Assistant Examiner*—Hanh V. Tran
(74) *Attorney, Agent, or Firm*—Reinhart Boerner van Deuren, S.C.

(57) ABSTRACT

An edge for removable attachment to a work surface includes a frame having a base and a vertical support orthogonally extending from the base. A wrist rest is affixed to the frame and is configured in ergonomic fashion to allow a user to rest his or her wrists and forearms against the edge in a natural position. The removable edge may easily be replaced when damaged or worn.

25 Claims, 2 Drawing Sheets

REMOVABLE EDGE SYSTEM FOR A WORK SURFACE

BACKGROUND OF THE INVENTION

Field of the Invention

The present invention relates to furniture edging, and more particularly, to an edge system which may be removably attached to a work surface to provide an ergonomic wrist support for use at a work station.

Traditionally, industrial or commercial tables and other work surfaces have been solely designed to support items placed atop of the table or work surface. These work surfaces normally have squared, rigid corners and edges that cause injury to people who bump against them. Further, regular activity at these work stations results in scuffed or damaged edges and corners which cannot be easily replaced. These same edges and corners are also sharp and abrupt, which limits the amount of time one may rest against the work surface without pain or discomfort.

With the advent of the computer, the design of and need for work surfaces have begun to change. People now spend more time in direct contact with the work surfaces, often spending hours leaning against the edge of the work surface or resting their arms upon the edge of the work surface while typing or performing other similar types of activities. As a result, manufacturers of work surfaces have begun to take into account the ergonomic considerations of those that work and sit at workstations to ensure injury is prevented, while at the same time, attempting to maintain the aesthetic qualities of the work surfaces.

One known method of constructing a work surface that addresses these concerns involves casting an ergonomic edge to the work surface core. This method requires the manufacturer to develop a mold which encapsulates the entire work surface, leaving an open space along a portion of the work surface where the edge is to be formed. A polymer is then extruded into the mold and is either chemically or thermally cured to provide the edging material. Once the polymer hardens it forms an edge which essentially becomes one with the work surface core. The disadvantages and limitations of this system are that the mold itself is expensive to develop and manufacturer. Any variation in size or shape of the work surface requires a new mold, which adds additional costs to the manufacturer. In addition, the edge cannot be easily replaced because it becomes permanently affixed to the work surface core. If the edge is damaged, the entire work surface is damaged and must be replaced.

Others have affixed pre-molded edging directly to the work surface core using adhesives to provide an ergonomic edge. An adhesive is applied along the work surface and the edging to affix the pre-molded edging to the work surface. The disadvantages and limitations of this type of system are that the adhesive tends to deteriorate over time decreasing the bond between the pre-molded edging and the work surface. This causes a gap to form between the pre-molded edging and the work surface in which liquids may seep and materials may fall which causes bacterial growth that will eventually rot the work surface. Further, the adhesive often protrudes from the seam formed between the pre-molded edging and the work surface. As a result, people tend to pick and pull at the seam gap and the protruding adhesive to damage the pre-molded edging. Like casted edges, once the adhesively affixed pre-molded edging is damaged, the entire work surface is damaged because the adhesive permanently affixes the pre-molded edging to the work surface core.

Another type of ergonomic edging system is disclosed in U.S. Pat. No. 6,025,047, to Catta, et al. Catta discloses a three-part system for providing an ergonomic edge including an aluminum carrier, a work surface core and a pliant casing. The aluminum carrier is joined to the work surface core by a tongue and groove relationship. The work surface core has a horizontal notch that divides a face of the work surface and runs the entire length of that face. The aluminum carrier has a stem which is configured to fit in mating relationship with the horizontal notch so that the two pieces can be joined. The aluminum carrier may also be screwed into the work surface core for a more secure fit. The pliant casing is then fit over and is secured to the aluminum carrier in a tongue and groove type fashion. To keep the pliant casing attached to the aluminum carrier, a retaining device tacks the pliant casing into place.

The edge system disclosed in Catta et al. requires considerable customization to fit the carrier to a work surface edge. For instance, the aluminum carrier must be individually cut to fit each work surface. If any curves are present, the aluminum carrier must be cut at regular intervals so that it may be bent around the curves. In addition, the retaining device that holds the pliant casing to the aluminum carrier eventually loosens causing the pliant casing to detach from the aluminum carrier. Further, a person must insert the pliant casing into the grooves of the aluminum carrier by hand, which takes time and if not properly done will leave an irregular surface between the plaint casing and the aluminum carrier. The seam formed between the plaint casing and the aluminum carrier is also an area where people may pull and pick which will damage the edging system disclosed in Catta.

To overcome the problems and disadvantages associated with the edging systems discussed above, it is an objective of the present invention to provide a removable edge system that may be quickly attached to a variety of work surfaces so that parts inventories can be reduced and economies of scale resulting from a longer production run or a single configuration are attained.

Another objective of the present invention is that the removable edge system should provide a tight seam between the work surface core and the removable edge system to prevent objects and liquid from falling or seeping within the seam, thereby preventing work surface rot and bacterial growth.

Yet another objective of the present invention is to provide a removable edge system that if damaged can be easily replaced without having to replace the entire work surface. The ergonomic edging system of the present invention should also be strong and durable to support the constant weight of a persons arm or wrist yet have the pliability and texture to provide a comfortable work surface.

Finally, it is also an objective of the removable edge system of the present invention that all of the aforesaid advantages and objectives be achieved without incurring any substantial relative disadvantage.

SUMMARY OF THE INVENTION

The disadvantages and limitations of the background art discussed above are overcome by an edge for removable attachment to a work surface as taught in accordance with the present invention.

The edge includes a frame having a base and a vertical support orthogonally extending from the base. The frame may be a unitary structure or may be constructed from a separate base and vertical support fitted together. When the frame is a unitary structure, the vertical support separates the base into an attaching member and an internal support. When the base and the vertical support are separate pieces, a groove is routered or molded into the base, separating the base into the attaching member and the internal support. The groove is dimensioned to fit the vertical support so that the vertical support rests within the groove at a right angle to the base.

The vertical support has a core face and a wrist rest face opposite the core face. Both the core face and the wrist rest face are exposed when the vertical support is engaged with the base, with the wrist rest face oriented towards the internal support and the core face oriented towards the attaching member. The vertical support may extend substantially the length of the base to provide rigidity to the edge.

A wrist rest is affixed to the frame and at least partially encapsulates the internal support of the base and the wrist rest face of the vertical support. The wrist rest has a front, a back, and a support surface which slopes downwardly from the back to the front. The back of the wrist rest encapsulates the wrist rest face of the vertical support, but leaves the core face exposed or only artificially covered so that its structure is apparent. The core face extends out from the back of wrist rest to form a ledge at a right angle to the back. The back of the wrist rest is larger than the length and width of the vertical support so that there is ample wrist rest material to abut the work surface and to provide cushioning to a user of the removable edge system.

The wrist rest is supported by the internal support of the base to prevent the wrist rest from becoming disfigured and to provide support when downward pressure is applied to the edge. The internal support may extend substantially to the front of the wrist rest or it may only partially extend into or under the wrist rest, depending on the degree of support desired. As discussed above, the wrist rest may fully encapsulate the internal support, or the wrist rest may partially encapsulate the internal support of the base leaving the bottom of the base exposed.

The removable edge may also be used in combination with a work surface to form a removable edge system. The work surface has a core with a top surface, a bottom surface and a front face. The work surface may also have a core lip which extends outwardly from the front face near the top surface. The core lip may be either an extension of the top surface or a separate piece affixed to the front face. If the core lip is an extension of the top surface, there will be no seam to accumulate fallen materials.

The edge is removably attached to the work surface by at least one removable fastener. The removable fastener removably attaches the attaching member to the work surface, which secures the edge to the work surface. The larger the edge, the more removable fasteners may be required to keep the edge secured to the work surface. Matching mounting holes may be counterbored or predrilled in the attaching member for matching engagement with the removable fasteners.

When the edge is removably attached to the work surface, the core face abuts the front face of the work surface with the front of the wrist rest extending away from the work surface. To provide a close fit and tight seam between the edge and the work surface, the core lip is positioned closely adjacent to the back of the wrist rest just above the ledge of the vertical support. The core lip fits in a mating type relationship with the ledge to prevent the vertical support from rotating when pressure is applied to the wrist rest. This reduces stress placed on the wrist rest and helps maintain a tight seam between the edge and the work surface.

The wrist rest may be coplanar with the top surface of the core to provide a continuous transition between the edge and the work surface. Alternatively, a portion of the wrist rest may rise above the plane of the top surface to prevent objects from rolling off of the work surface and to provide an easier transition to objects being supported by the work surface. The wrist rest may be constructed from polyurethane foam which has a comfortable feel and it affixes to the frame in a suitable manner, although, most any material will suffice.

To provide a more seamless appearing work surface with a removable edge, a mounting recess may be routered or molded into the work surface core at the front face near the bottom surface. The mounting recess can be dimensioned to fit the attaching member of the base so that the attaching member is flush with the bottom surface of the core. However, the mounting recess may be dimensioned to only fit a portion of the attaching member so that the attaching member is not coplanar with the bottom surface.

A work surface with a removable edge taught in accordance with this invention may be constructed by first providing a pre-assembled edge including a frame with a base and a vertical support orthogonally extending from the base. The vertical support separates the base into an attaching member and an internal support. A wrist rest may then be affixed to the internal support and a portion of the vertical support though a molding process. A mold fits over the frame and the edge material is extruded into the mold to cure and adhere to the internal support and the wrist rest face or by other methods apparent to those skilled in the art. The removable edge can be then be removably attached to the work surface by at least one removable fastener.

As mentioned above, the base and the vertical support may form a unitary frame, or the base and the vertical support may be two separate pieces fitted together to form the frame. In addition, at least one mounting hole may be counterbored into the attaching member for engagement with at least one matching removable fastener. Further, the wrist rest may be designed so that it slopes downwardly from the back towards the front of the wrist rest forming an incline that provides an ergonomic surface, which helps reduce injury. Otherwise, the support surface may be relatively horizontal between the front and the back of the wrist rest to provide a flat, but comfortable removable edge.

Thus, it may be seen that the removable edge system of the present invention overcomes the problems and disadvantages of the approaches to other edging systems discussed above. The removable edge system of the present invention may be quickly attached to a variety of work surfaces so that parts inventories are reduced and economies of scale are attained as a result of longer production runs and simpler configurations.

The removable edge system of the present invention also provides a tight seam between the work surface core and the removable edge system to prevent objects from falling and liquids from seeping within the seam, thereby preventing work surface rot and bacterial growth.

In addition, the removable edge system of the present invention can be easily replaced if damaged without having to replace the entire work surface. The removable edge system of the present invention is also strong and durable to support the constant weight of a person's arm or wrist yet has the pliability and texture to provide a comfortable work surface.

Finally, the removable edge system of the present invention achieves all of the aforesaid advantages and objectives without incurring any substantial relative disadvantage.

The above summary sets forth rather broadly the most important features of the present invention so that the detailed description that follows may be better understood, and so that the present contributions to the art may be better appreciated. There are, of course, additional features of the invention that will be described hereinafter, which will form the subject matter of the invention. In this respect, before explaining an embodiment of the invention in detail, it is to be understood that the invention is not limited in its application. The details of the construction and the arrangements set forth in the following description are illustrated in the drawings. However, the present invention is capable of other embodiments and of being practiced and carried out in various ways, as will be appreciated by those skilled in the art. Also, it is to be understood that the phraseology and terminology employed herein are for description only and not limitation.

BRIEF DESCRIPTION OF THE DRAWINGS

The advantages of the present invention are best understood with reference to the drawings, in which.

DETAILED DESCRIPTION OF THE PREFERRED EMBODIMENTS

Figure 1:
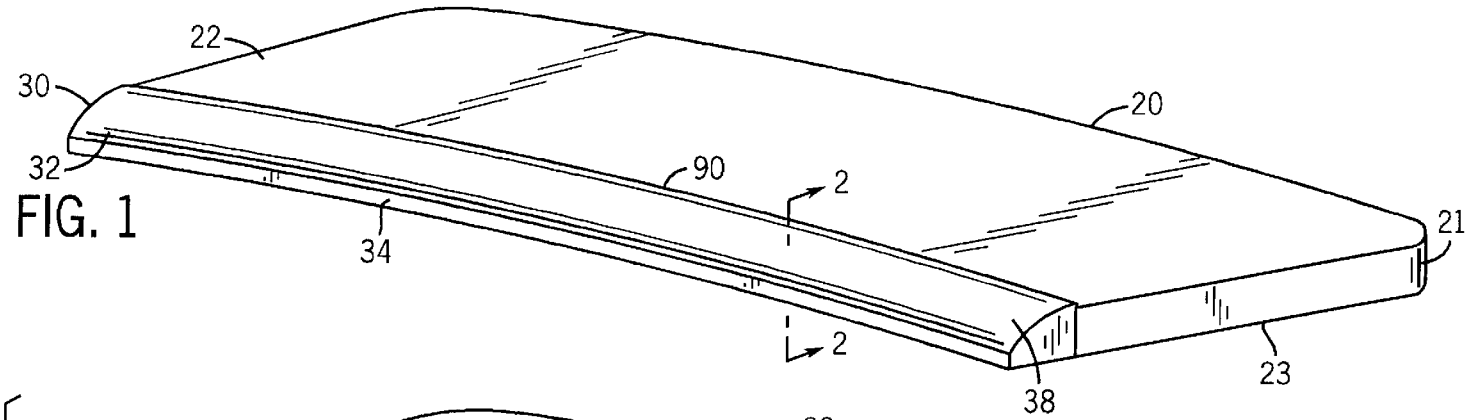
FIG. 1 is a front perspective view of a fully assembled work surface having a removable edge system which is taught in accordance with the present invention.

FIG. 1 shows a work surface 20 having a removably attached edge 30. The work surface 20 includes a core 21 having a top surface 22 for supporting items placed on the work surface 20 and a bottom surface 23 opposite the top surface 22. The edge 30 is removably attached to a front face 24 of the work surface core 21 (not shown). The front face 24 and method of attachment are discussed in more detail below. The core 21 may be made of a single substrate such as wood or plastic, or it may be a laminate of a variety of materials, including wood, FORMICA, adhesives and synthetic polymers. In addition, the work surface 20 may be supported by legs or a pedestal, or it may also be attached to a larger work surface (not shown).

The removable edge 30 shown in FIG. 1 includes a wrist rest 32 with a front 34, a back 36 (not shown), and a support surface 38 that slopes downwardly from the back 36 of the work surface 20 to the front 34 of the work surface 20 at an angle. The sloping support surface 38 provides a smooth transition between the edge 30 and the top surface 22 of the core 21, and also provides an ergonomic advantage as it allows the wrist to rest against the edge 30 in a natural position, thereby eliminating undesired and harmful stress to the musculature and skeleton. Although a sloping support surface 38 is preferred, the support surface 38 may be substantially horizontal between the back 36 and the front 34 of the wrist rest 32. The wrist rest 32 is made from a material that adequately supports a wrist or arm yet provides a sufficient degree of comfort in the form of cushioning and temperature conductivity. Polyurethane is a good example of such a material, however, any foam-type material or material that has a soft, cushioning and pliable feel may be used to construct the edge 30. The edge 30 may also be constructed from the same materials as the work surface 20 or any other material if desired.

Figure 3:
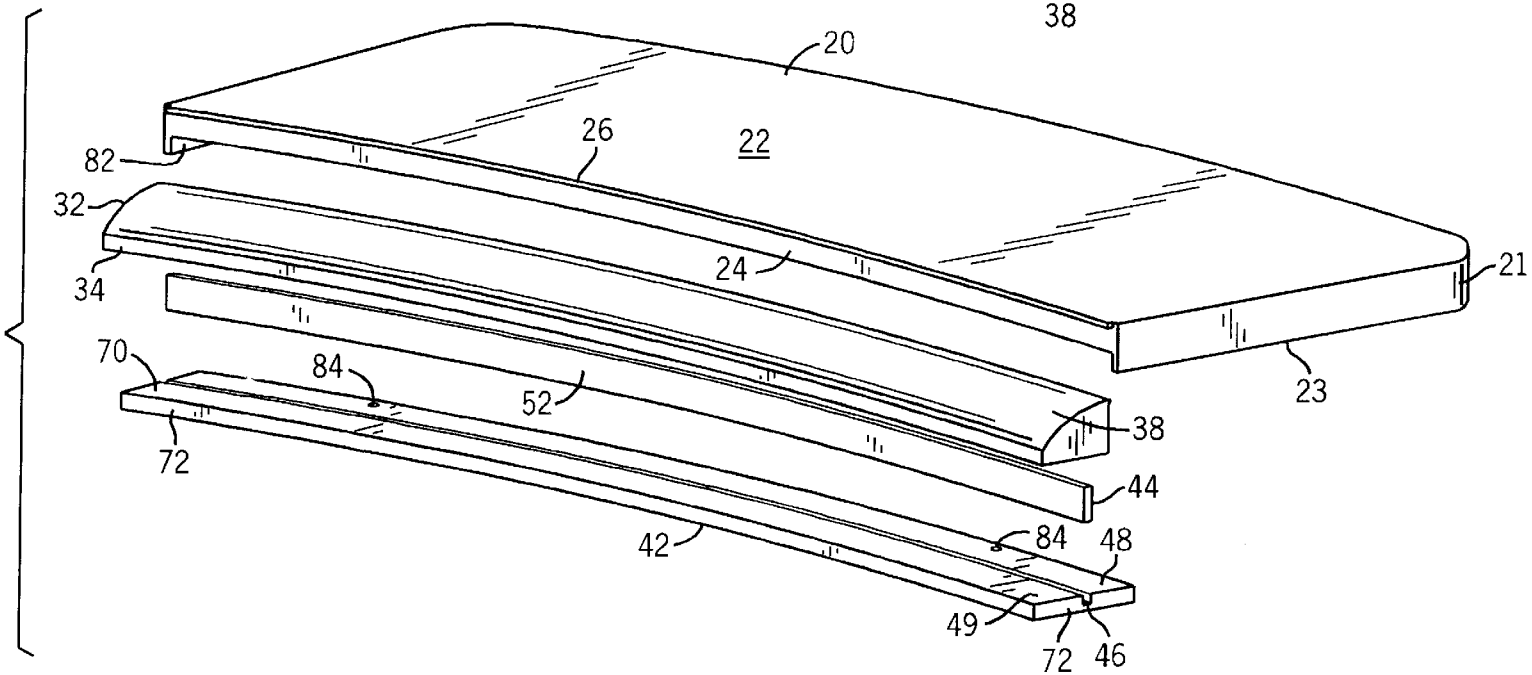
FIG. 3 is an exploded view of the removable edge and the work surface as shown in FIG. 1.
Figure 2:
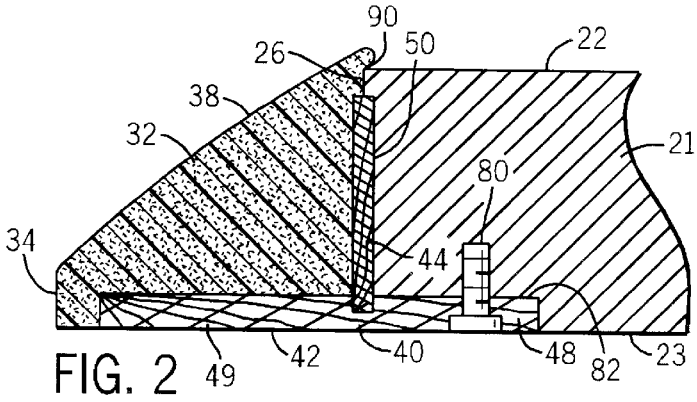
FIG. 2 is a cross sectional view of the work surface having the removable edge system as shown in FIG. 1.

FIGS. 2 and 3 more clearly display the removable edge 30. FIG. 2 depicts the edge 30, which is made from a frame 40 having a base 42 and a vertical support 44 orthogonally projecting from the base 42. The base 42 and the vertical support 44 may be constructed from two separate pieces of wood, plastic, metal or a combination of the same as shown in FIG. 3. When the base 42 and the vertical support 44 are separate pieces, the vertical support 44 rests within a groove 46 routered, molded or formed within the base 42. Referring again to FIG. 2, the vertical support 44 and the groove 46 fit together in a fashion similar to a slotted tenon joint, with the width of the groove 46 substantially matching the width of the vertical support 44 to provide for a secure fit between the vertical support 44 and the base 42. Depending on the length of the vertical support 44, the groove 46 may either run the entire length of the base 42 or only partially along the base 42. The groove 46 also separates the base 42 into an attaching member 48 and an internal support 49.

In an alternative embodiment, the frame 40 may be a unitary structure constructed from a single piece of material by a mold, form or other methods commonly known by those skilled in the art. When the frame 40 is a unitary structure, the vertical support 44 separates the base 42 into the attaching member 48 and the internal support 49. As discussed above, the material used to make the base 42 and the vertical support 44 may be wood, plastic or any other material known by those skilled in the art.

The vertical support 44 is generally rectangular with a length greater than either the width or depth. The vertical support 44 has a core face 50 and wrist rest face 52 opposite the core face 50. When the vertical support 44 is engaged with the base 42, the core face 50 is oriented towards the attaching member 48 of the base 42 and the wrist rest face 52 is oriented towards to internal support 49. The vertical support 44 may run the entire length of the base 42, or in the alternative, the vertical support 44 may only run along a portion of the base 42. In addition, the vertical support 44 may be a single strip of material for each removable edge 30, or the vertical support 44 may arranged end-to-end in multiple segments for each removable edge 30.

Figure 4:
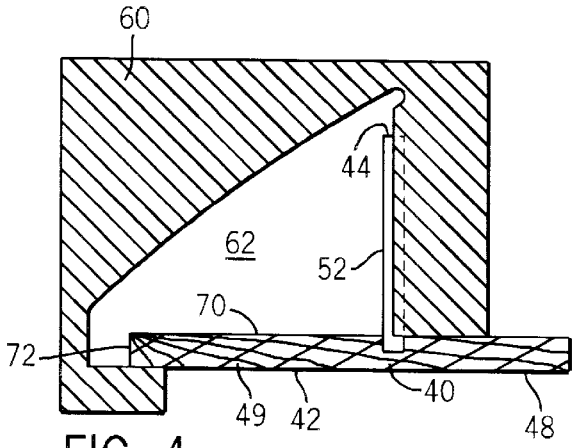
FIG. 4 is a cross sectional view of a mold surrounding a frame for constructing a wrist rest for a removable edge taught in accordance with the present invention.

The wrist rest 32 is formed over the frame 40 through the use of a mold 60 as shown in FIG. 4, or by some other method well known in the art. The mold 60 is developed to fit over the frame 40, leaving those portions of the frame 40 exposed where the wrist rest 32 is desired. In the preferred embodiment, the mold 60 surrounds a space 62 which extends over the internal support 49 and a portion of the wrist rest face 68 of the vertical support 44. A wrist rest material is then extruded into the mold 60, where it is hardened either by chemical or temperature catalysts. During the curing process, the wrist rest material adheres to the internal support 49 and the wrist rest face 52, forming the wrist rest 32 and the edge 30.

The polyurethane or other material used to construct the wrist rest 32 may fully encapsulate the internal support 49 or encapsulate only the contact surface 70 and the sides 72 of the internal support 49, leaving the bottom portion of the base 42 exposed. However, the corners and edges of the internal support 49 of the base 42 should be covered to prevent injury to people or damage to objects which bump against the edge 30. In addition, the wrist rest 32 only partially encapsulates the vertical support 44, covering only the wrist rest face 52. The core face 50 of the vertical support 44 remains uncovered by the wrist rest 32 so that a portion of the vertical support 44 extends out from the wrist rest 32 at a right angle to form a ledge 54 as more clearly shown in FIG. 5. It would be apparent to one of ordinary skill in the art to construct an edge 30 with wrist rest 32 artificially encapsulating the core face 50 so that the ledge 54 remains functional, albeit covered by a thin layer of the wrist rest material.

Referring again to FIG. 2, the internal support 49 may extend up to substantially the front 34 of the wrist rest 32 to provide a surface area to support the wrist rest 32. This prevents the wrist rest 32 from losing its shape over time and also provides rigidity so that pressure may be applied to the wrist rest 32 during regular working activities, such as typing and leaning against the edge 30. Other embodiments may have an internal support 49 that extends only partially into or under the wrist rest 32, especially if the wrist rest material is rigid enough to provide its own support.

The edge 30 may be removably attached to the front face 24 of the work surface 20 by at least one removable fastener 80. The wrist rest 32 and the internal support 49 extend away from the front face 24 as shown in FIG. 2. In the preferred embodiment, the attaching member 48 of the base 42 fits in mating relationship with a mounting recess 82 routered or formed out of the front face 24 near the bottom surface 23 of the work surface core 21. The mounting recess 82 is preferably dimensioned to fit the attaching member 48 so that the attaching member 48 is substantially flush with the bottom surface 23 of the core 21 when the edge 30 is attached. Although the mounting recess 82 provides for an aesthetically desirable work surface 20, it would be apparent to one of ordinary skill in the art to eliminate the mounting recess 82 in its entirety or to provide an alternative sized mounting recess 82 resulting in an uneven transition between the attaching member 48 and the bottom surface 23 of the core 21.

The edge 30 is positioned against the front face 24 so that the core face 50 is closely adjacent to the front face 24. In this position, the core face 50 and the ledge 54 of the vertical support 44 interface with a core lip 26, which extends from the top surface 22 at a right angle to the front face 24 of the core 21. The core lip 26 may run substantially the length of the front face 24, or only along a portion of the front face 24. The ledge 54 is positioned under the core lip 26 in dado joint fashion when the core face 50 is positioned closely adjacent the front face 24. In this position, the core lip 26 prevents the vertical support 44 from rotating as pressure is applied to the edge 30. In addition, when the edge 30 is removably attached to the work surface 20, the core face 50 and the ledge 54 work to form a vacuum between the edge 30 and the front face 24, thereby creating a stronger seal between the edge 30 and the core 21. The core lip 26 may either be an extension of the top surface 22, or it may be a separate piece of material affixed to the front face 24. An alternative embodiment of the present invention may utilize a work surface 20 without a core lip 26, which may still provide for a tight seam 90 as the wrist rest 32 may be firmly pressed against the front face 24.

The core lip 26 is closely adjacent to the wrist rest 32 and forms a seam 90 between the work surface 20 and the edge 30. As shown in FIG. 2, the support surface 38 of the wrist rest 32 rises slightly above the plane of the top surface 22 at a slight angle. This configuration permits close interaction with the core lip 26 to tightly seal the seam 90, thereby preventing objects from falling or liquids from seeping between the edge 30 and the work surface core 21. In other embodiments, the wrist rest 32 may also be attached to the frame 40 and configured so that the support surface 38 is coplanar with the top surface 22 of the work surface 20 or even slightly below the top surface 22.

Figure 5:
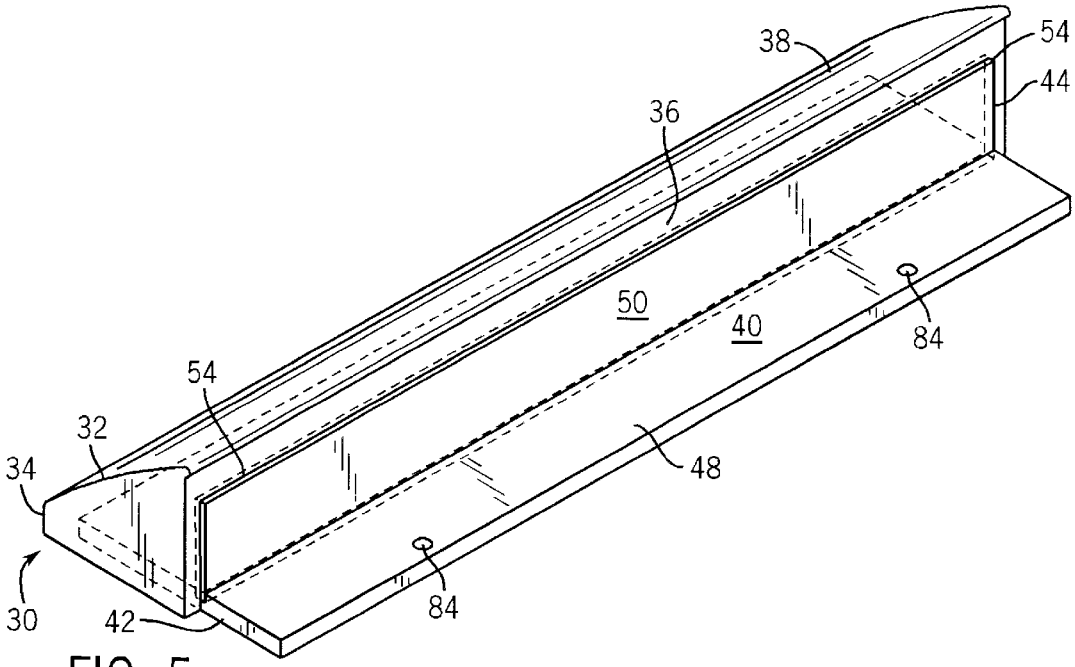
FIG. 5 is a rear perspective view of the removable edge for removable attachment to a work surface as taught in accordance with the present invention.

At least one removable fastener 80 removably attaches the edge 30 to the core 21. In the preferred embodiment, the removable fastener 80 removably attaches the attaching member 48 of the base 42 to the core 21. The removable fastener 80 may be in the form of a traditional screw, bolt, or pin, or the removable fastener 80 may be a more untraditional fastener such as a hook-loop fastener, clip and other fastener known by those of ordinary skill in the art to removably attach two pieces of materials. One or more matching mounting holes 84 may also be counterbored through the attaching member 48 to match each removable fastener 80 as shown in FIG. 5.

The edge 30 may also be curved to fit like curved work surfaces. In addition, the edge 30 may be constructed to provide an edging for corners of a work surface. Should the edge 30 ever become damaged, the edge 30 may simply be removed and replaced with a new edge 30 designed to fit the same work surface 20.

The above-described embodiments of the present invention are meant to be illustrative of the preferred embodiments and are not meant for limitation. Various modifications, which would be readily apparent to one of ordinary skill in the art, are intended to be within the scope of the present invention. The only limitations to the scope of the present invention are set out in the following claims.

What is claimed is:

1. An edge for removable attachment to a work surface, said edge comprising:

a frame having a base and a vertical support orthogonally extending from said base;

a wrist rest affixed to said frame and at least partially encapsulating said base and said vertical support; and a groove separating said base into an attaching member and an internal support, said vertical support secured within said groove.

2. The edge of claim 1 wherein said wrist rest partially encapsulates said internal support.

3. The edge of claim 2 further comprising at least one removable fastener to removably attach said attaching member to said work surface.

4. The edge of claim 2 wherein said attaching member surrounds at least one mounting hole for receiving at least one removable fastener.

5. The edge of claim 1 wherein said vertical support extends substantially the length of said base.

6. The edge of claim 1 wherein said internal support extends outward from said vertical support to provide rigidity to said wrist rest.

7. A removable edge system comprising:

a work surface core having a top surface, a bottom surface and a front face;

an edge including a frame having a base and a substantially vertical support extending from said base, said base having a groove separating said base into an internal support and an attaching member, said vertical support secured within said groove; and a wrist rest at least partially encapsulating said internal support and said vertical support.

8. The removable edge system of claim 7 further comprising a core lip extending outwardly and normal to said front face near said top surface, said core lip closely adjacent to said wrist rest when said edge is removable attached to said work surface core.

9. The removable edge system of claim 7 wherein a portion of said wrist rest extends above the plane of said top surface of said work surface core.

10. The removable edge system of claim 7 further comprising a removable fastener to removably attach said attaching member to said core.

11. The removable edge system of claim 7 wherein said bottom surface surrounds a mounting recess at said front face for mating engagement with said attaching member.

12. A removable edge for a work surface comprising:

a base with a groove defining an internal support and an attaching member;

a vertical support secured within said groove and extending outwardly from said base;

said vertical support having a core face oriented towards said attaching member and a wrist rest face oriented towards said internal support and opposite said core face; and a wrist rest affixed to said internal support and said wrist rest face of said vertical support, said wrist rest having a front, a back, and a support surface downwardly sloping from said back to said front.

13. The removable edge of claim 12 wherein said back of said wrist rest is dimensioned larger than said vertical support, and said core face of said vertical support extends outwardly from said wrist rest to form a ledge normal to said back of said wrist rest.

14. The removable edge of claim 12 wherein said internal support extends substantially to said front of said wrist rest.

15. The removable edge of claim 14 wherein said wrist rest partially encapsulates said internal support.

16. The removable edge of claim 12 wherein said wrist rest is constructed from polyurethane foam.

17. A work surface with a removable edge comprising:

an edge including a base including a groove separating said base into an attaching member and an internal support;

a wrist rest having a front, a back, and a surface sloping downwardly from said back to said front, said wrist rest affixed to said base; and a vertical support secured within said groove and extending outwardly from said base and closely adjacent to said back of said wrist rest, said vertical support having a core face opposite said wrist rest and a ledge perpendicular to said back of said wrist rest and said core face;

a work surface including a core having a front face and a core lip outwardly extending from said front face, said core lip closely adjacent to said wrist rest and superior said ledge; and at least one removable fastener removably attaching said base to said work surface.

18. The work surface with a removable edge according to claim 17 wherein two removable fasteners are used to removably attache said base to said work surface.

19. The work surface with a removable edge according to claim 17 wherein said wrist rest partially encapsulates said vertical support.

20. The work surface with a removable edge according to claim 17 wherein said attaching member extends outwardly from said back of said wrist rest and said front face has a mounting recess for receiving said attaching member.

21. The work surface with a removable edge according to claim 17 wherein said internal support extends into or under said wrist rest.

22. A method of forming a work surface with a removable edge comprising the steps of:

producing a removable edge by providing a frame having a base and a vertical support;

providing a groove in said base, separating said base into an attaching member and an internal support;

securing said vertical support in said groove with said vertical support extending from said base;

affixing a wrist rest to said internal support and a portion of said vertical support; and attaching said removable edge to said work surface.

23. The method of forming a work surface with a removable edge according to claim 22 wherein affixing said wrist rest to said frame includes fitting a mold over said frame with the mold surrounding a space that extends over the internal support and a portion of the vertical support; extruding a wrist rest material into the mold; and allowing said wrist rest material to cure and adhere to said frame, forming the wrist rest.

24. The method of forming a work surface with a removable edge according to claim 22 further comprising the step of counterboring at least one mounting hole into said attaching member for receiving at least one removable fastener.

25. The method of forming a work surface with a removable edge according to claim 22 wherein said edge is removably attached to said work surface by at least one removable fastener.

* * * * *